US005299959A

United States Patent [19]

Yamamoto et al.

[11] Patent Number: 5,299,959

[45] Date of Patent: Apr. 5, 1994

[54] ELECTRICAL CONNECTOR

[75] Inventors: Masayuki Yamamoto; Kazuaki Sakurai; Toshiro Maejima, all of Shizuoka, Japan

[73] Assignee: Yazaki Corporation, Tokyo, Japan

[21] Appl. No.: 897,054

[22] Filed: Jun. 11, 1992

[30] Foreign Application Priority Data

Jun. 13, 1991 [JP] Japan ..... 3-141591
Apr. 8, 1992 [JP] Japan ..... 4-087316
Apr. 13, 1992 [JP] Japan ..... 4-092702

[51] Int. Cl.[5] ..... H01R 13/514
[52] U.S. Cl. ..... 439/752; 439/595
[58] Field of Search ..... 439/595, 752

[56] References Cited

U.S. PATENT DOCUMENTS 4,758,181 7/1988 Anbo et al. .
4,867,711 9/1989 Yuasa ..... 439/752
4,921,448 5/1990 Endo et al. .
4,946,398 8/1990 Takenouchi et al. .
4,959,023 9/1990 Watanabe et al. ..... 439/752 X
5,100,345 3/1992 Endo et al. ..... 439/752 X

FOREIGN PATENT DOCUMENTS 0344691 12/1989 European Pat. Off. .
4010440 10/1991 Fed. Rep. of Germany .

*Primary Examiner*—Eugene F. Desmond
*Attorney, Agent, or Firm*—Sughrue, Mion, Zinn, Macpeak & Seas

[57] ABSTRACT

An electrical connector includes a housing having terminal chambers, terminals which are inserted into the chambers, and a terminal engagement holder provided with a locking anchor for an engagement portion of the housing in order to be assembled with the housing by two-steps of manipulation, which are a step of tentatively engaging the holder with the housing, and the other step of thereafter engaging the holder with the housing on a full scale. The locking anchor functions to urge the holder toward the housing while the holder is in the full-scale engagement with the rear portion of the housing, so that the holder can be surely engaged with the housing on the full scale even if the rear end of each of the terminals is located slightly behind a prescribed position.

10 Claims, 17 Drawing Sheets

ELECTRICAL CONNECTOR

BACKGROUND OF THE INVENTION

The present invention relates to an electrical connector, more particularly to an improved electrical connector including a terminal engagement holder for preventing the terminals of the connector from inadvertently being removed rearwardly from the housing of the connector after being inserted into the terminal chambers of the housing.

An electrical connector includes terminals, terminal chambers, and engagement means which are so-called terminal lances or case lances provided on the terminals or the chambers in order to prevent the terminals from inadvertently being removed rearwardly off backward from the chambers after being inserted into them. Each of the terminal lances is formed by cutting and bending a portion of the terminal, and engaging that portion in an engagement groove provided in the inside surface on the terminal chamber. Each of the case lances is a flexible engagement arm provided on the inside surface on the terminal chamber, and engaged with the shoulder of the terminal or in the engagement opening thereof. However, such a terminal lance and such a case lance have become smaller in size along with the increase in the number of the terminals of such an electrical connector or the reduction in the size of the terminal so that it has become difficult to maintain the strength and holding power of the lances sufficiently high enough. For that reason, a terminal engagement holder manufactured separately from a housing has recently been used along with such engagement means to increase the terminal holding power of an electrical connector to enhance the reliability of electrical connection thereof.

FIG. 12A and 12B show a conventional electrical connector including such a terminal engagement holder b and disclosed in the Japan Patent Examined Publication No. Hei. 1-43986. The holder b is tentatively engaged with the housing a of the connector as shown in FIG. 12A, and is thereafter engaged with the housing on a full scale as shown in FIG. 12B. While the holder b is in the tentative engagement with the housing a, terminals c are inserted into the terminal chambers $a_1$ of the housing so that the engagement portions $c_1$ of the terminals are engaged with the terminal engagement claws $a_2$ of the housing to subject the terminals to primary engagement holding. The holder b is thereafter engaged with the housing a on a full scale so that the edges $b_1$ of the holder are engaged with the terminals c to subject them to secondary engagement holding.

Since the terminal engagement holder b of the above-mentioned conventional electrical connector has a butting corner portion $b_2$ for preventing the holder from being unexpectedly engaged with the housing a on the full scale as the holder is manipulated to be tentatively engaged therewith, shifting the holder out of the tentative engagement into the full-scale engagement requires two steps of manipulation, which are a step of moving the holder sideward in a direction p, and another step of thereafter moving the holder forward in a direction g. This is a problem of less efficiency. Besides, the terminal is likely to be slightly longer than a prescribed length due to the elongative caulking of the electric wire connecting portion $c_2$ of the terminal, the dimensional error of the terminal or the like so that the rear end $c_2'$ is located behind a prescribed position, as shown by a two-dot chain line in FIG. 12B, to make it impossible to lock the holder b to the housing a. Further, the holder b needs to be in the full-scale engagement with the housing a when the connector is fitted with another electrical connector for their mutual electrical connection. However, because of the constitution of the conventional connector, it is necessary to confirm by eyesight whether or not the holder b is in the full-scale engagement with the housing a. The confirmation is troublesome requiring a high degree of care. Furthermore, if a tensile force acts on an electric wire W in a direction r reverse to the former p and g while the holder b is in the full-scale engagement with the housing a, as shown in FIG. 12B, the holder is shifted out of the full-scale engagement back into the tentative engagement so that the terminals c are no longer being retained in a double engagement holding.

SUMMARY OF THE INVENTION

The present invention was made in order to solve the above-mentioned problems.

Accordingly, it is an object of the invention to provide an electrical connector whose terminal engagement holder can be shifted out of tentative engagement with a housing into full-scale engagement therewith by a single step of manipulation.

It is another object of the present invention to provide an electrical connector whose terminal engagement holder can be surely locked to the housing to firmly hold the terminals in the housing even if the rear end of each of the terminals is located slightly behind a prescribed position due to a dimensional error, the elongative caulking of the terminal or the like.

Yet another object of the present invention is to provide an electrical connector whose terminal engagement holder can be easily judged from outside about whether or not the holder is in the full-scale engagement with the housing.

Still another object of the present invention is to provide an electrical connector in which the terminal engagement holder is positively prevented from being unexpectedly shifted out of the full-scale engagement back into the tentative engagement by an external force.

In order to attain the above-noted and other objects, the present invention provides an electrical connector, which comprises a housing having at least one terminal chamber; a terminal inserted into each the terminal chamber; a terminal engagement holder mounted onto the housing for preventing each the terminal from coming off from the housing; first means for tentatively engaging the terminal engagement holder with the housing by moving the terminal engagement holder in a first direction relative to the housing; and second means for engaging the engagement holder with the housing on full scale by moving the terminal engagement holder tentatively engaged with the housing in a second direction substantially perpendicular to the first direction.

The connector may further comprise third means for urging the terminal engagement holder toward the housing when the terminal engagement holder is engaged with the housing on the full scale.

The connector may further comprise a bracket insertion portion for fixing the housing onto a bracket, having an opening for inserting the bracket into the bracket insertion portion, wherein the opening is substantially closed by the terminal engagement holder tentatively engaged with the housing to prevent the insertion of the bracket, and the opening is opened to enable the insertion of the bracket when the terminal engagement holder is engaged with the housing on the full scale.

The connector may further comprise fourth means for positively preventing the terminal engagement holder from being shifted cut of the full-scale engagement with the housing back into the tentative engagement therewith.

The present invention further provides an electrical connector, comprising: a housing having at least one terminal chamber; a terminal inserted into each the terminal chamber; a terminal engagement holder to be assembled with the housing; tentative engagement means for tentatively engaging the holder with a rear portion of the housing; and full-scale engagement means for engaging the holder with the portion on a full scale after the holder is tentatively engaged with the housing, and wherein: at least one of the tentative engagement means and full-scale engagement means includes means for urging the holder toward the housing when the holder is in the full-engagement with the portion.

The present invention further provides an electrical connector, comprising: a housing having at least one terminal chamber; a terminal inserted into each the terminal chamber; a terminal engagement holder to be assembled with the housing; tentative engagement means for tentatively engaging the holder with a rear portion of the housing; full-scale engagement means for engaging the holder with the portion on a full scale after the holder is tentatively engaged with the housing; and a bracket insertion portion formed on an outer surface of the housing and having a bracket reception opening whose open end is located at a rear end of the housing so that the open end is blocked by the holder in the tentative engagement, and not blocked by the holder in the full-scale engagement.

The present invention further provides an electrical connector, comprising: a housing having at least one terminal chamber; a terminal inserted into each the terminal chamber; a terminal engagement holder to be assembled with the housing; tentative engagement means for tentatively engaging the holder with a rear portion of the housing; full-scale engagement means for engaging the holder with the portion on a full scale after the holder is tentatively engaged with the housing; and means provided on the portion for preventing the holder from being shifted out of the full-scale engagement back into the tentative engagement.

BRIEF DESCRIPTION OF THE DRAWINGS

In the accompanying drawings:

FIG. 13 to 20 show a connector according to still another embodiment of the present invention, in which:

FIG. 13 is a perspective view of a female housing of the connector;

FIG. 14 is a cutaway side view of the connector;

FIG. 15 is a rear view of the housing;

FIG. 18 is a sectional view of the connector to illustrate the state that a bracket cannot be inserted into it to lock them to each other;

FIG. 19 is a sectional view of the connector to illustrate the state that the bracket is about to be inserted into it to lock them to each other; and FIG. 20 is a sectional view of the connector to illustrate that state that the bracket is inserted into it and they are locked to each other; and FIG. 21 to 27 show an electrical connector according to further another embodiment of the present invention, in which:

FIG. 21 is an exploded perspective view of the connector;

FIG. 22 is a side view of the connector;

FIG. 23 is a rear view of a male housing of the connector;

DETAILED DESCRIPTION OF THE PREFERRED EMBODIMENTS

Figure 1:
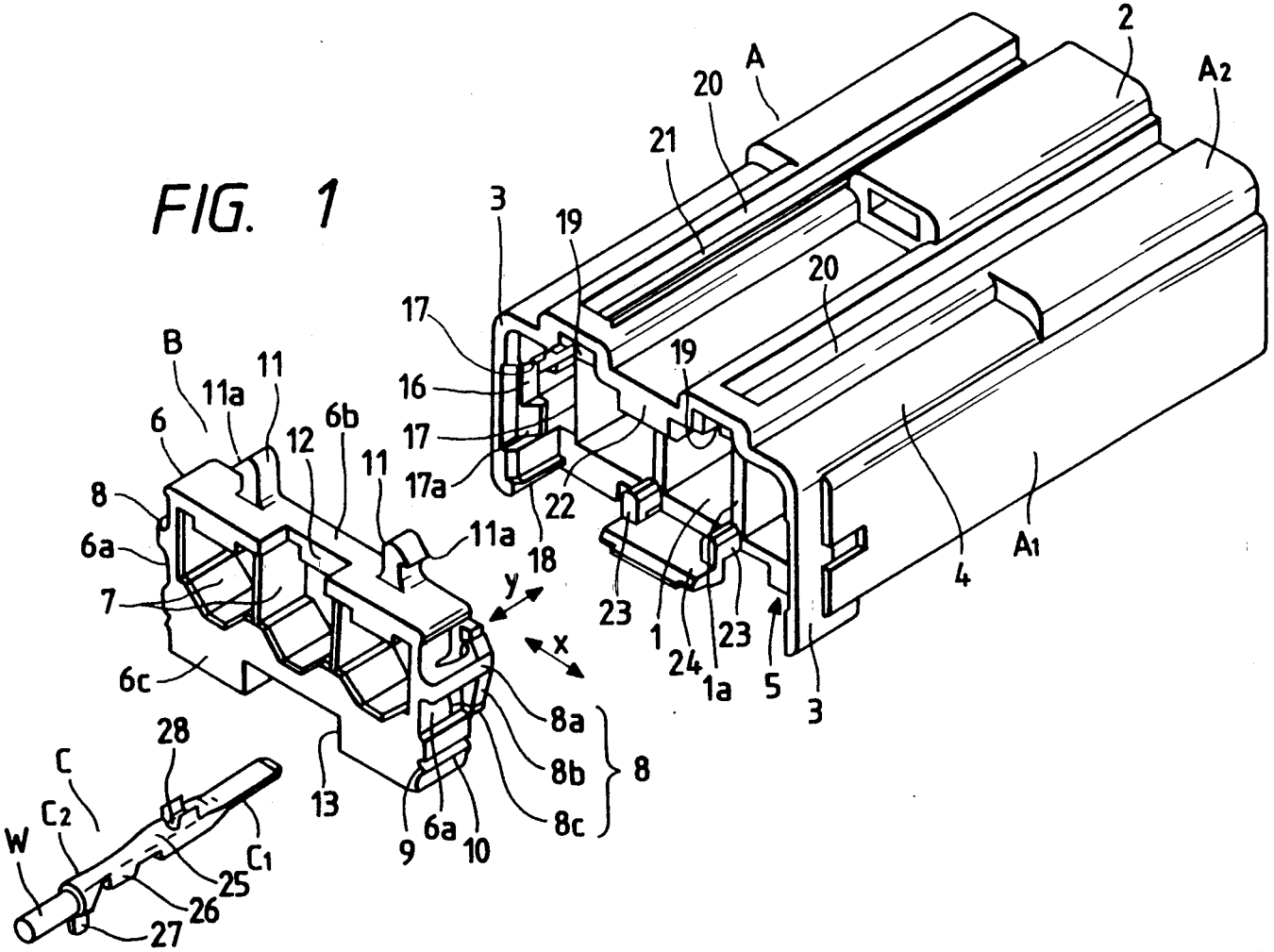
FIG. 1 is an exploded perspective view of an electrical connector according to an embodiment of the present invention.

Embodiments of the present invention are hereafter described with reference to the drawings attached hereto.

FIGS. 1, 2, 3 and 4 show an electrical connector which is one of the embodiments. The connector comprises a female connector housing A made of a synthetic resin, a terminal engagement holder B made of a synthetic resin, and male terminals C which are coupled with electric wires W at the ends thereof.

The housing A has a body $A_1$ having a plurality (three in this embodiment) of mutually-juxtaposed terminal chambers 1 in which the terminals C are accommodated for engagement, and a hood $A_2$ formed on the body at the front end thereof so as to receive a male connector housing (not shown in the drawings) in the hood. The upper portion of the hood $A_2$ has a locking hole 2 into which the locking arm (not shown in the drawings) of the male housing is inserted to lock the male and the female housings to each other. The body $A_1$ has both side portions 3 and an upper portion 4 inside which a holder fitting opening 5, in which the terminal engagement holder B is fitted, is defined at the rear end of the body.

Figure 4A:
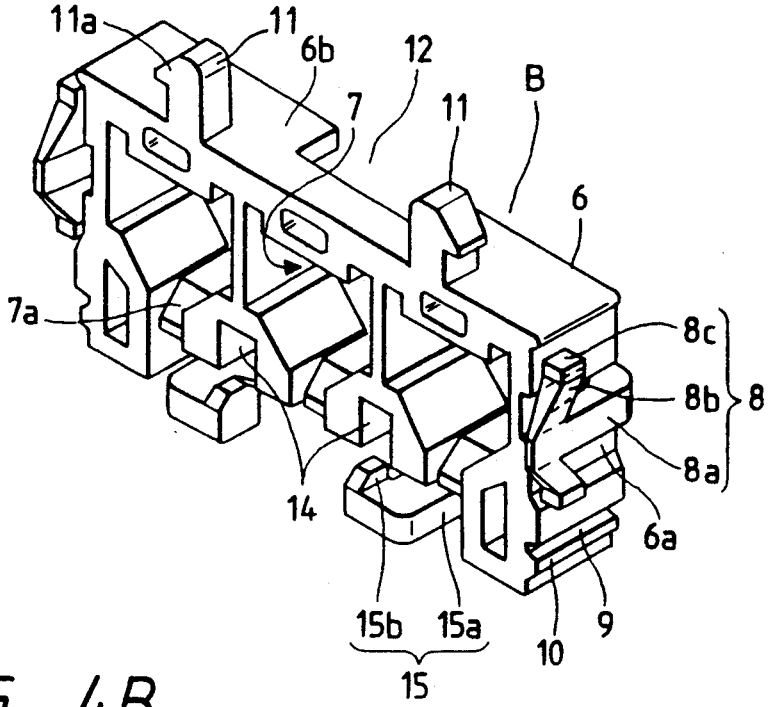
FIG. 4A is a perspective view of a terminal engagement holder of the connector, as viewed backward.
Figure 4B:
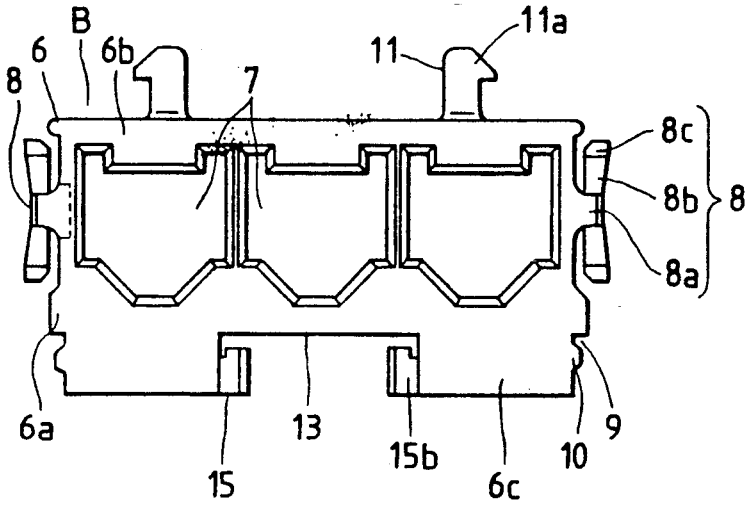
FIG. 4B is a rear view of the holder.
Figure 4C:
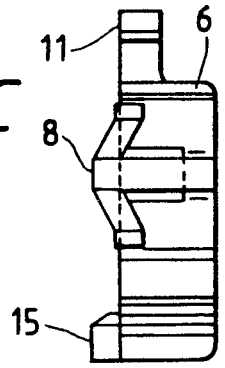
FIG. 4C is a left-hand side view of the holder.

The terminal engagement holder 3 has a frame-like body 6 having a plurality of openings 7 corresponding to the terminal chambers 1 of the female housing A. The cross-sectional area of each opening 7 is large enough to pass the corresponding male terminal C through the opening, and may be smaller than that of the corresponding terminal chamber 1. The body 6 has push-in engagement slopes 7*a* at the front ends of the openings 7, as shown in FIG. 4, to make it easy to push and engage the male terminals C into the terminal chambers 1 of the female housing A, and includes a right and a left side portion 6*a*, the outer part of each of which has a locking anchor 8, an engagement groove 9 and an engagement projection 10 for the female housing, an upper portion 6*b* having a pair of engagement juts 11 and a recess 12, and a lower portion 6*c*. The locking anchor 8 has a horizontally flexible arm 8*a* extending from the rear of the side portion 6*a* to the front thereof, and flexible juts 8*b* extending up and down from the tip of the arm and flexible backward and forward as locking springs to be bent backward, and is thus shaped as T. The free tip portions 8*c* of the flexible juts 8*b* serve as engagement portions. The arm 8*a* is elastically displaceable in the transverse direction x of the connector, while the juts 8*b* are elastically displaceable in the longitudinal direction y thereof. Each engagement jut 11 is shaped as a hook, and has an engagement claw 11*a* projecting outward in the transverse direction of the connector. The lower portion 6*c* of the frame-like body 6 has a recess 13 at the bottom of the central part of the portion, a pair of grooves 14 (shown in FIG. 4) in the front half of the portion at both the sides of the recess, and a pair of anti-turning arms 15 extending forward from facets on the recess.

Figure 8:
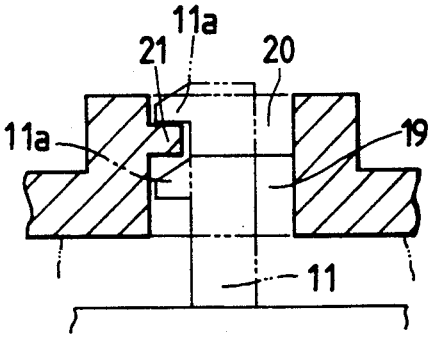
FIG. 8 is an enlarged view of showing an engagement jut of the holder, in which the solid line illustrate the engagement jut in the tentative engagement and the two-dotted chain line illustrate the engagement jut in the full-scale engagement.

The inner surface of each side portion 3 of the housing body $A_1$ has an upper and a lower engagement portion 17 extending on the holder fitting opening 5 and located over and under a passage 16 for the flexible arm 8*a* of the locking anchor 8 so as to be engaged with the engagement tip portions 8*c* of the flexible juts 8*b* of the anchor. The side portion 3 has an engagement projection 18 at the bottom of the portion in order to fit the projection in the engagement groove 9 of the body 6 of the terminal engagement holder B. The upper portion 4 of the outer housing body $A_1$ has two engagement openings 19 formed by partially expanding the portion, to fit the engagement juts 11 of the upper portion 6*b* of the holder body 6 in the openings. Each engagement opening 19 has an upper part 20 under which an engagement projection 21 is provided on the upper portion 4 as shown in FIG. 8. The upper portion 4 has an engagement part 22 between the engagement openings 19 to fit the part in the recess 12 of the upper portion 6*b* of the holder body 6. The housing body $A_1$ has positioning juts 23 provided at the bottom of the rear end of the body and located on the rear ends of partition walls 1*a* for the terminal chambers 1 of the body so as to be fitted in the grooves 14 of the lower portion 6*c* of the holder body 6, and a guide tongue 24 having an L-shaped cross section and coupling the juts to each other at the bottoms thereof.

Each of the male terminals C includes a body 25 made of an electroconductive metal plate generally bent as a tube of rectangular cross section, an electroconductive contact portion $C_1$ extending forward from the body, and an electric wire connecting portion $C_2$. The contact portion $C_1$ is formed as a double plate construction tab by bending the plate backward. The wire connecting portion $C_2$ has a pair of wire conductor pinching parts 26, and a pair of wire insulator pinching parts 27 behind which the terminal C may have a stabilizer not shown in the drawings.

The way of using the terminal engagement holder B and the operation thereof are described from now on. The holder B is first inserted into the female housing A at the rear end thereof so that the holder is tentatively engaged with the housing. The terminals C are then inserted into the terminal chambers 1 of the housing A so that the terminals are engaged therewith. The holder B is thereafter slid up on the female housing A so that the holder is engaged therewith on a full scale to prevent the terminals C from coming off the housing backward. The holder B and the terminals C are thus assembled with the female housing A.

Figure 2:
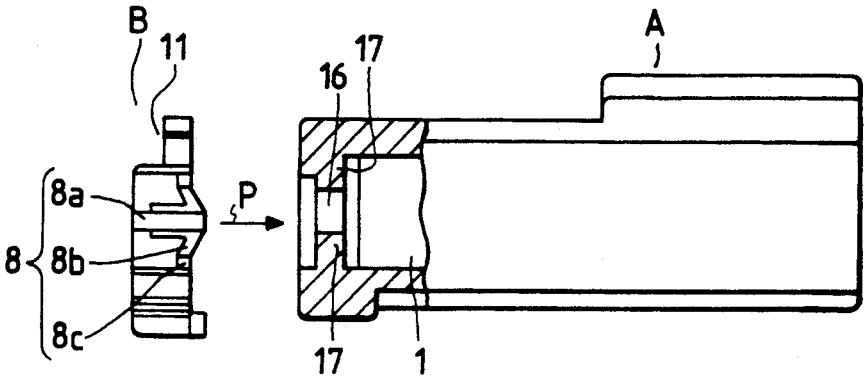
FIG. 2 is a cutaway side view of the connector.
Figure 3:
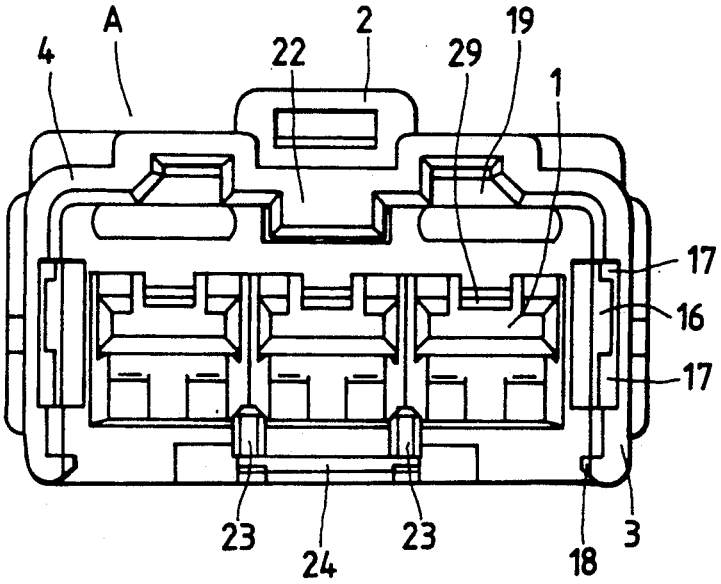
FIG. 3 is a rear view of a female housing of the connector.
Figure 6A:
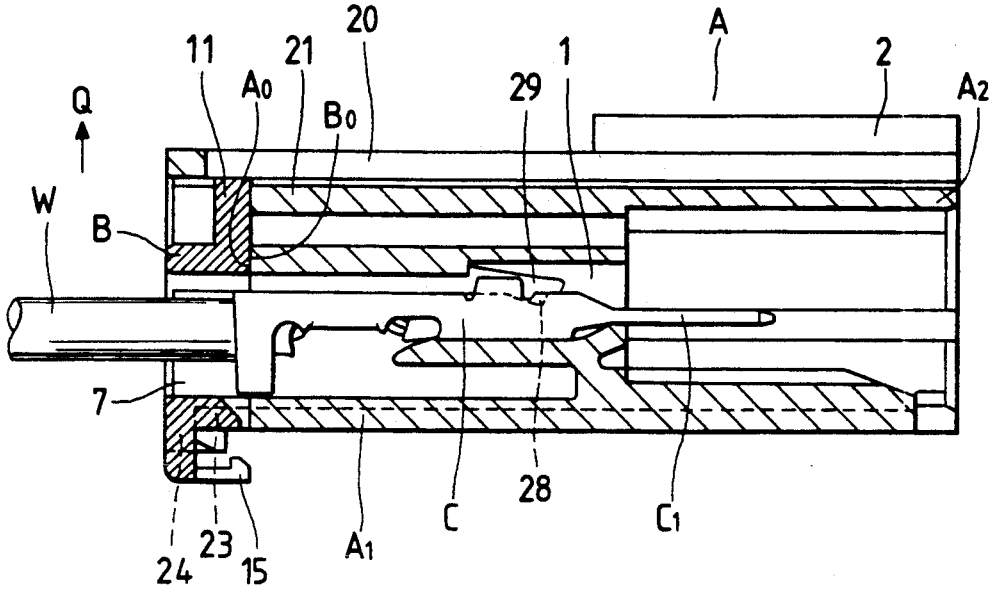
FIG. 6A is a sectional view of a major part of the connector to illustrate the state that the holder is tentatively engaged with housing.

For the assembling, the terminal engagement holder B is first inserted into the holder fitting opening 5 of the housing A in a direction P as shown in FIG. 2. At that time, the holder B is engaged at the engagement grooves 9 thereof with the engagement projections 18 of the side portions 3 of the housing A and guided by the projections so as to be entered into the opening 5, and is supported at the recess 13 of the lower portion 6c of the holder by the guide tongue 24 of the housing. The two engagement juts 11 of the holder are put into the engagement openings 19 of the housing, and the positioning juts 23 of the housing are fitted in the grooves 14 of the holder at: the front thereof. During the entry, the upper and lower engagement tip portions 8c of the flexible juts 8b of the locking anchors 8 of the holder B are slid on and guided by the oblique parts 17a of the engagement portions 17 of the inner surfaces of the side portions 3 of the housing A so that the locking anchors 8 are initially elastically flexed inwardly and elastically flexed back to their original positions at the time of the completion of the passing of the engagement tip portions by the oblique parts. At that time, the front $B_0$ of the holder B comes into contact with the rear $A_0$ of the housing A as shown in FIG. 6A, and the rear surfaces of the engagement tip portions 8c are engaged with the engagement portions 17 so that the holder is tentatively engaged with the housing so that the terminal will not move backwardly, and is urged toward the housing by the spring actions of the flexible juts 8b formed as locking springs.

Figure 5A:
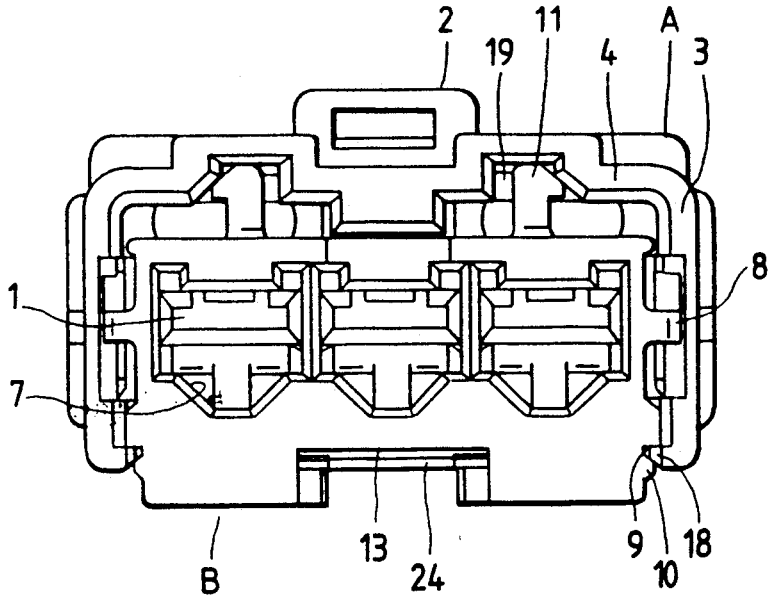
FIG. 5A is a rear view of the housing to illustrate the state that the holder is tentatively engaged with the holder.
Figure 5B:
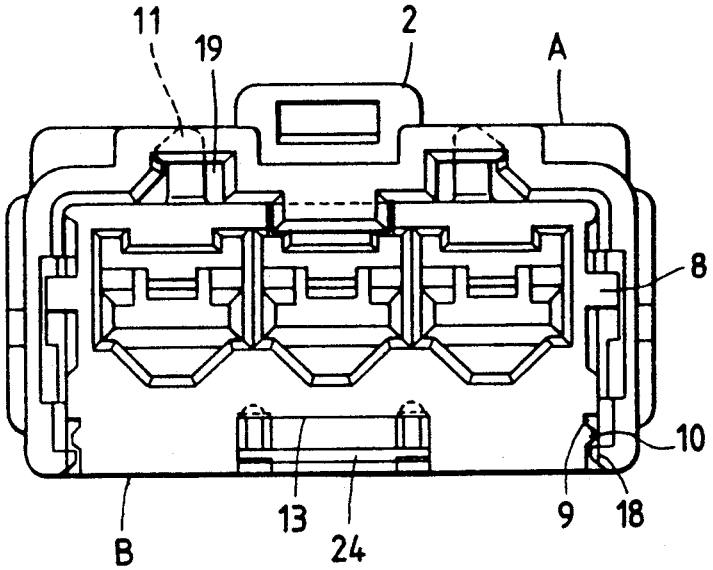
FIG. 5B is a rear view of the housing to illustrate the state that the holder is engaged with the housing on a full scale.
Figure 6B:
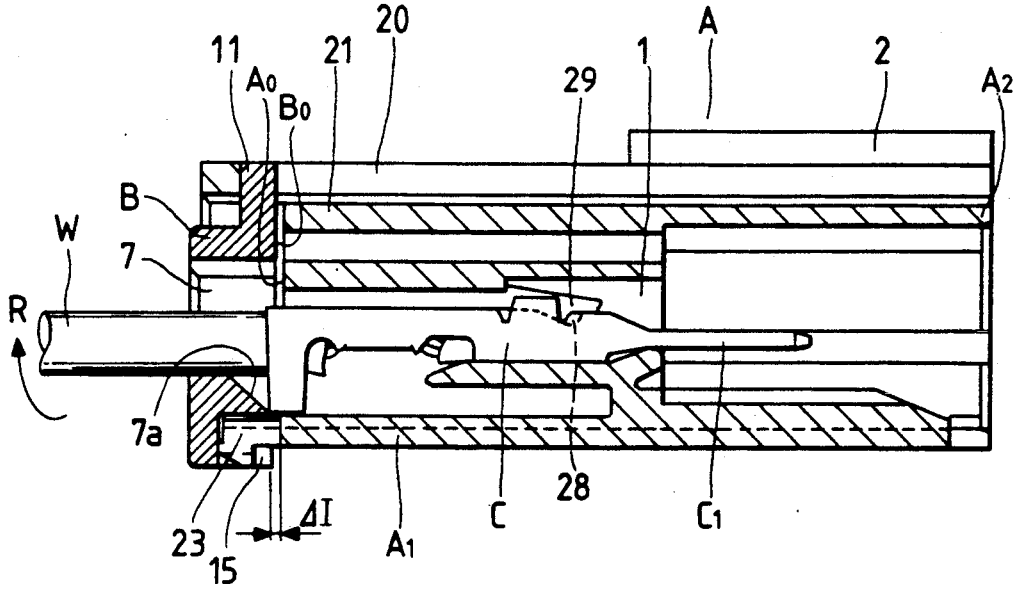
FIG. 6B is a sectional view of the major part to illustrate the state that the holder is engaged with the housing on the full scale.

When the holder B is tentatively engaged with the housing A, the engagement projections 18 of the housing are fitted in the engagement grooves 9 of the holder as shown in FIG. 5A, and the engagement claws 11a of the engagement juts 11 of the holder is abutted against the full-scale engagement projections 21 in the engagement openings 19 of the housing as shown in FIG. 8, so that the holder is kept from playing vertically relative to the housing, and the openings 7 of the holder are made concentric to the terminal chambers 1 of the housing. Since the housing A has the guide tongue 24, the holder B is more surely kept from moving downward in particular. After the tentative engagement, the terminals C coupled with the electric wires W are inserted into terminal chambers 1 of the female housing A through the openings 7 of the holder B, as shown in FIG. 6A, so that flexible engagement arms 29 formed on the upper portion 4 of the housing and extending into the terminal chambers are fitted in the engagement openings 28 of the terminals to prevent them from coming off the housing backward. The terminals C are thus primarily engaged with the housing A and held therein. The holder B is thereafter slid up on the rear of the housing in a direction Q. At that time, the holder B in surface contact with the housing A is pushed up so that the engagement projections 18 of the housing are disengaged out of the engagement grooves 9 of the holder, the engagement claws 11a of the engagement juts 11 of the holder are moved up into the upper parts 20 of the engagement openings 19 of the housing beyond the full-scale engagement projections 21 thereof, and the holder is supported at the engagement projections 10 of both the side portions thereof by the engagement projections 18 of the housing. The holder B is thus engaged with the housing A on the full scale, as shown in FIGS. 5B and 6B. In that state, not only the engagement claws 11a of the engagement juts 11 are fitted in the upper parts 20 of the engagement openings 19, and the engagement projections 10 are engaged with the engagement projections 18, but also the engagement projections 15b of the anti-turning arms 15 of the holder B are engaged with the bottom of the guide tongue 24 of the housing A, and the engagement part 22 of the upper portion 4 of the housing is fitted in the recess 12 of the holder B, so that the holder is surely prevented from coming off the housing backward.

Figure 7A:
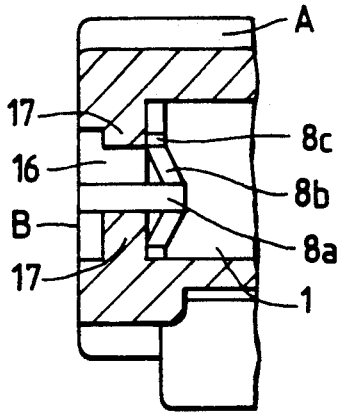
FIG. 7A is an enlarged sectional view showing a locking anchor of the holder where the holder is tentatively engaged with the housing.
Figure 7B:
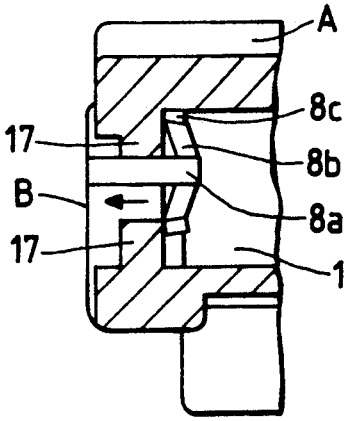
FIG. 7B is an enlarged sectional view showing the anchor where the holder is engaged with the housing on full scale.

Even if the tension of the electric wire W acts to the terminal C in the above-mentioned state, the holder B functions as a stopper for the wire insulator pinching rear parts 27 of the terminal so that both the above-mentioned primary engagement of the terminal and the stopper function of the holder surely prevent the terminal from coming off the housing A backward. If the terminal C is in the state of slightly incomplete insertion in the terminal chamber 1 of the housing A at the time of the sliding of the holder out of the tentative engagement into the full-scale engagement, the push-in engagement slope 7a of the holder, which is provided at the front end of the opening 7, is engaged with the wire insulator pinching rear parts 27 of the terminal to push it forward to completely insert the terminal into the chamber. Such incomplete insertion can thus be corrected to be complete. Even if a turning force acts to the holder B due to the tension of the election wire W as shown by an arrow R in FIG. 6B, the anti-turning arms 15 engaged with the guide tongue 24 of the housing A as mentioned above prevent the holder from being put out of the full-scale engagement. Even if the rear end 27a of each wire insulator pinching part 27 of the terminal C virtually completely inserted into the terminal chamber 1 of the housing A projects by a small length $\Delta 1$ from the rear end of the chamber due to a dimensional error, the elongative caulking of the terminal on the electric wire W or the like, as shown in FIGS. 6B and 7B, the holder B can be put and kept in the full-scale engagement with the housing as the holder remains located behind a prescribed position against the elastic urging forces of the flexible juts 8b of the locking anchors 8 thereof.

It will be understood through the above description that means for tentatively engaging the terminal engagement holder B with the outer housing A to keep the holder from being unexpectedly disengaged therefrom, and means for engaging the holder with the housing on the full scale to keep the holder from being unexpectedly disengaged therefrom comprise the locking anchors 8 of the holder and the engagement potions 17 of the inner surfaces of the side portions 3 of the housing. In the state of the tentative engagement, both the engagement grooves 9 of the holder B and the engagement projections 18 of the housing A, and/or both the recess 13 of the holder and the guide tongue 24 of the housing act to support the holder to prevent it from coming off the housing. In the state of the full-scale engagement, both the engagement claws 11a of the engagement juts 11 of the holder B and the full-scale engagement projections 21 of the housing A, and/or both the engagement grooves 10 of the holder and the engagement projections 18 of the housing act to support the holder to prevent it from coming off the housing. Both the recess 12 of the holder B and the engagement part 22 of the housing A, and/or both the anti-turning arms 15 of the holder and the guide tongue 24 of the housing are effective enough to maintain and reinforce the full-scale engagement.

Although the terminal chambers 1 of the female housing A are horizontally juxtaposed together in the above-described embodiment, the present invention may be otherwise embodied so that terminal chambers are vertically piled together in an female housing, and openings are also vertically piled together in a terminal engagement holder to correspond to the chambers. Since the holder B is formed independently of the flexible engagement arms 29 of the female housing A, which are case lances as engagement means to be engaged with the terminals C to keep them fitted in the terminal chambers 1 of the housing, the holder can be also applied to an female housing and male terminals having terminal lances as engagement means to be engaged in the engagement grooves of the housing to keep the terminals fitted in the terminal chambers thereof. Besides, the holder B can be also applied to a male housing where female terminals are inserted into and retained to terminal chambers of the housing.

Figure 9:
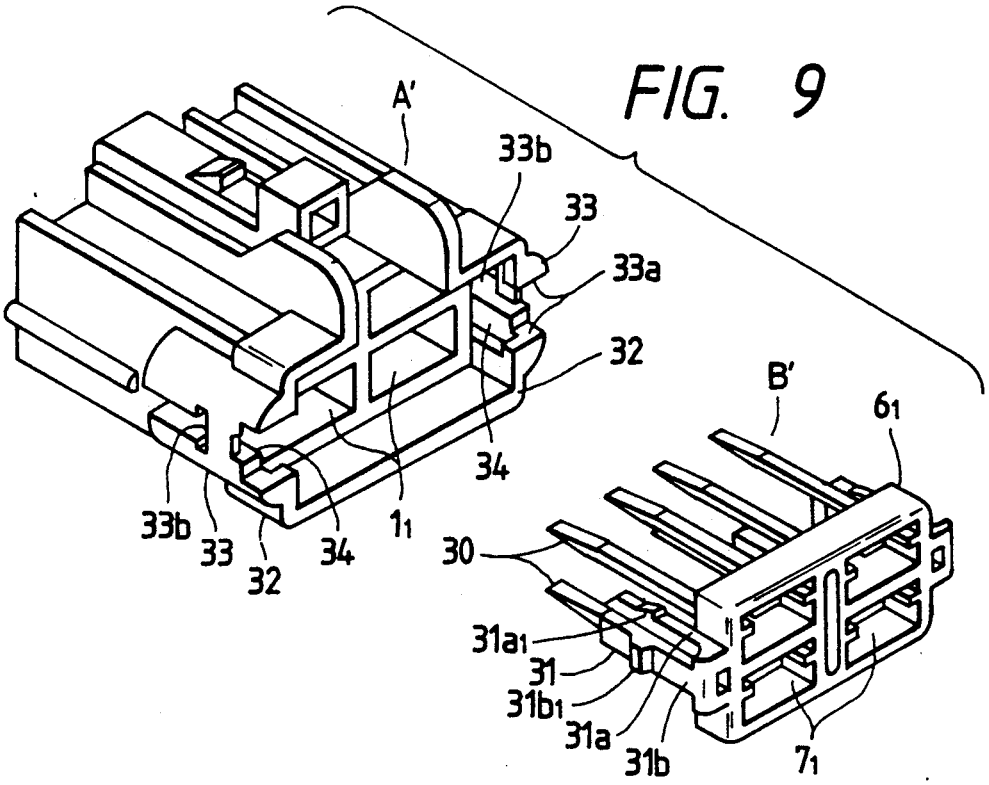
FIG. 9 is an exploded perspective view of an electrical connector according to another embodiment of the present invention.
Figure 10:
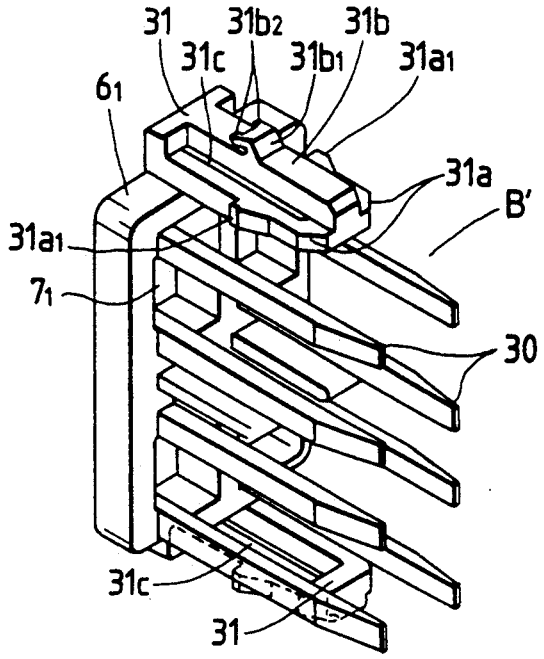
FIG. 10 is an enlarged perspective view of a terminal engagement holder of the connector shown in FIG. 9.

FIGS. 9 and 10 show an electrical connector which is another of the embodiments. FIG. 9 is a perspective view of the connector. FIG. 10 is an enlarged perspective view of the terminal engagement holder B' of the connector. The connector is described mainly with reference to the difference thereof from the preceding one from now on. The connector comprises an outer housing A' having terminal chambers $1_1$ in an upper and a lower row, inner terminals not shown in the drawings, and the holder B' which has a frame-like body $6_1$ having openings $7_1$, a plurality of flexible engagement juts 30 extending forward from the body and corresponding to the terminal chambers, and flexible locking anchors 31 extending forward from both the side portions of the body so as to be engaged with the housing.

Each of the locking anchors 31 has a pair of upper and lower vertically-flexible arms 31*a* extending along each other with a gap 31*c* between them, and a horizontally flexible arm 31*b* extending along the gap outside it and movable into and out of the gap. Tentative engagement projections $31a_1$ are formed on the vertically flexible arms 31*a*. A full-scale engagement projection $31b_1$ is formed on the horizontally flexible arm 31*b* behind the former projections. Flexible pins $31b_2$ are formed on the rear of the full-scale engagement projection $31b_1$, and extend divergently backward therefrom.

The housing A' has protuberant walls 33 formed on both the side walls 32 of the housing at the rear end thereof, and arm receiving portions 34 formed on the side walls at the rear ends thereof so as to receive the locking anchors 31 in the portions. Each protuberant wall 33 has an upper and a lower engagement portion 33*a* facing the arm receiving portion 34 and located at the rear end of the wall so as to be engaged with the tentative engagement projection $31a_1$ of the locking anchor 31, and another engagement portion 33*b* constituting the outer portion of the wall in front of the former engagement portions so as to be engaged with the full-scale engagement projection $31b_1$ of the anchor.

Before the female terminals are inserted into the terminal chambers $1_1$ of the outer housing A' through the openings $7_1$ of the terminal engagement holder B' and engaged with the housing, the tentative engagement projections $31a_1$ of the vertically flexible arms 31*a* of the holder are engaged with the engagement portions 33*a* of the housing at the arm receiving portions 34 thereof so that the holder is tentatively engaged with the housing. This manipulation is similar to that described above with reference to FIG. 6A. After the insertion and engagement of the female terminals into the housing A', the holder B' is pushed deeper into the housing to engage the flexible pins $31b_2$ of the holder at the full-scale engagement projections $31b_1$ of the locking anchors 31 thereof with the engagement portions 33*b* of the housing at the arm receiving portions 34 thereof so that the holder is engaged with the housing on a full scale. At that time, the flexible engagement juts 30 of the holder B' are moved forward and engaged with the female terminals in the housing A' to subject the terminals to double engagement holding to prevent them from coming off the housing backward. Even if the rear end of the inner terminal projects by a small length Δ1 from the rear end of the outer housing A' due to a dimensional error, the elongative caulking of the terminal or the like similarly to the case shown in FIGS. 6B and 7B, the holder B' can be put and kept in the full-scale engagement with the housing as the holder remains located behind a prescribed position against the elastic urging forces of the flexible pins $31b_2$ thereof. The connector thus assembled functions as a male connector.

Figure 11:
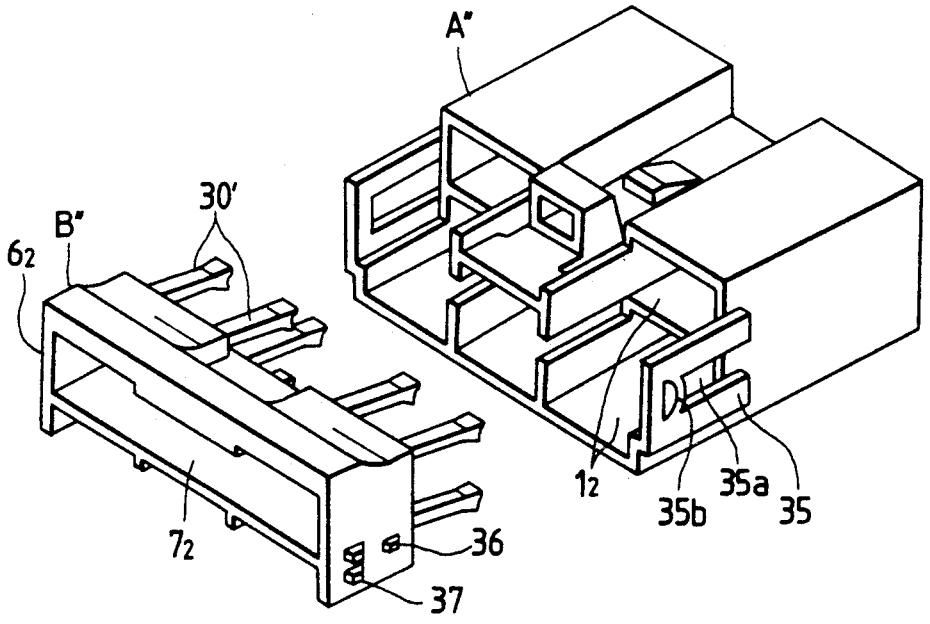
FIG. 11 is an exploded perspective view of an electrical connector according to yet another embodiment of the present invention.
Figure 12A:
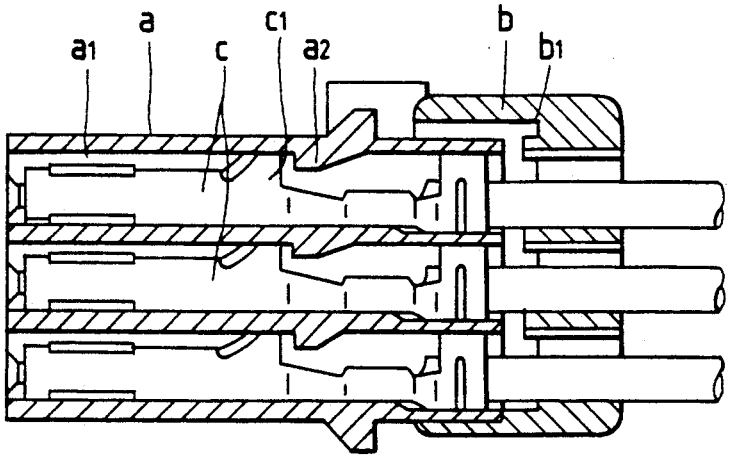
FIG. 12A is a sectional view of a major part of a conventional electrical connector to illustrate the state that a terminal engagement holder is tentatively engaged with a housing.
Figure 12B:
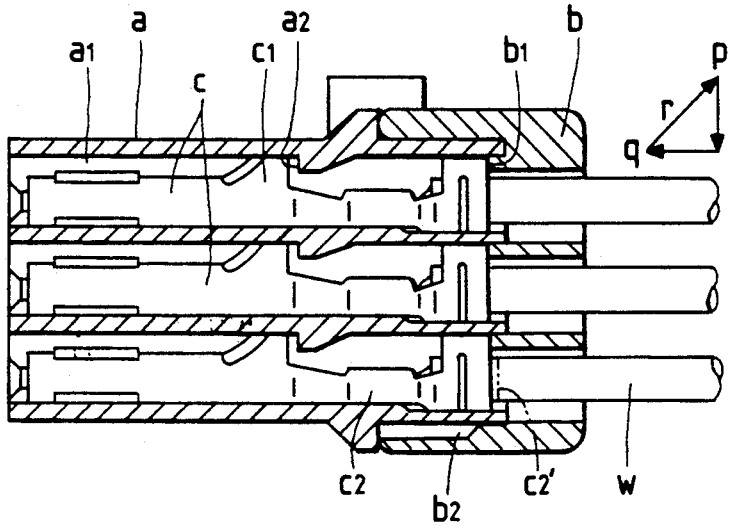
FIG. 12B is a sectional view of the major part of the conventional connector to illustrate the state that the holder is engaged with the housing on a full scale.

FIG. 11 shows an electrical connector which is yet another of the embodiments and functions as a male connector. The connector is described mainly with regard to the difference thereof from the most preceding one from now on. The connector comprises an outer housing A" having a plurality of terminal chambers $1_2$ in an upper and a lower rows, female terminals not shown in the drawing, and a terminal engagement holder B" which has a frame-like body $6_2$ having an opening $7_2$, a plurality of flexible engagement juts 30' extending forward from the body and corresponding to the terminal chambers, tentative engagement projections 36 formed on both the side portions of the body so as to be engaged in the engagement openings 35*a* of the flexible locking anchors 35 of the housing, and full-scale engagement projections 37 formed on the side portions of the body behind the former projections so as to be engaged in the engagement openings. The locking anchors 35 have arc-shaped flexible parts 35*b* located at the rear ends of the engagement openings 35*a* and elastically displaceable backward and forward so as to perform the same action as the flexible pins $31b_2$ of the former holder B' when the latter B" is engaged with the housing A" on a full scale.

FIGS. 13 to 20 show a connector according to yet another embodiment of the present invention. Reference should be made to the drawings where like reference numerals refer to like parts.

Figure 13:
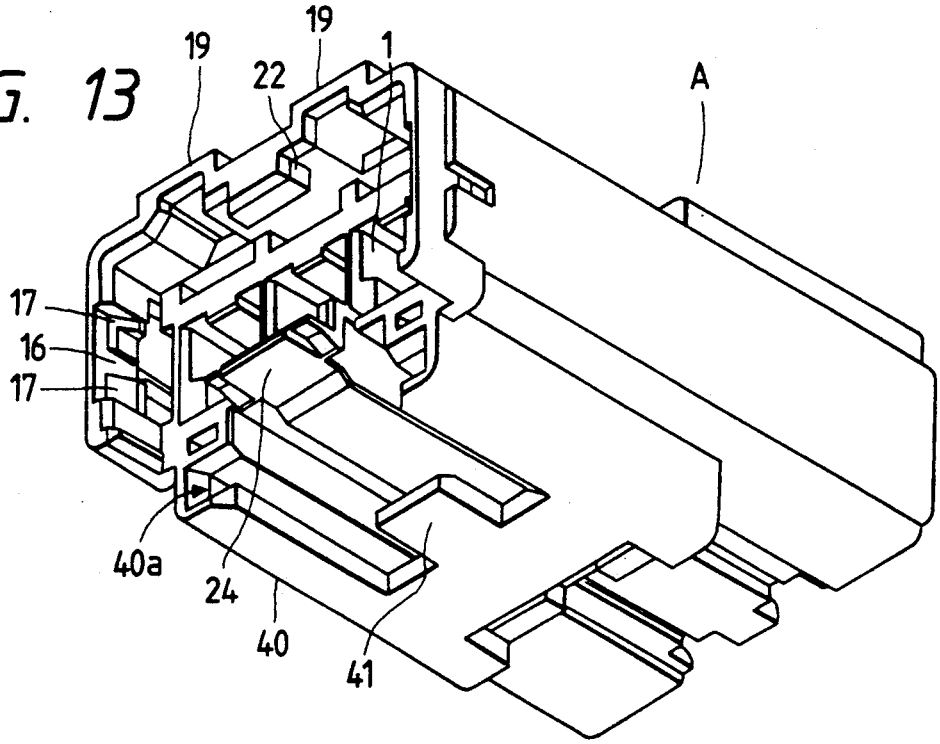
Figure 14:
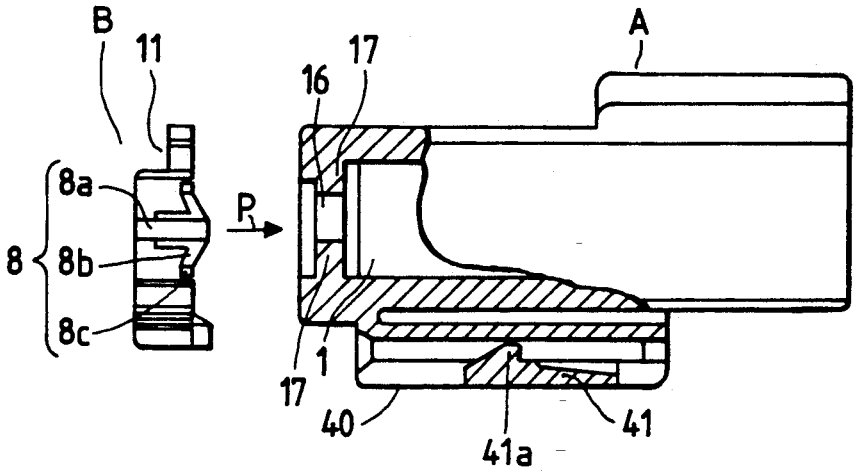
Figure 15:
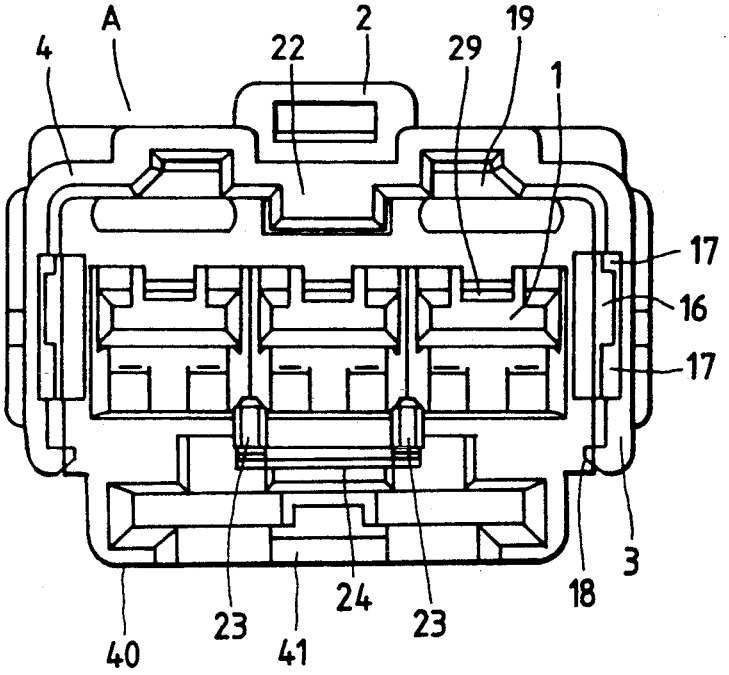
Figure 16A:
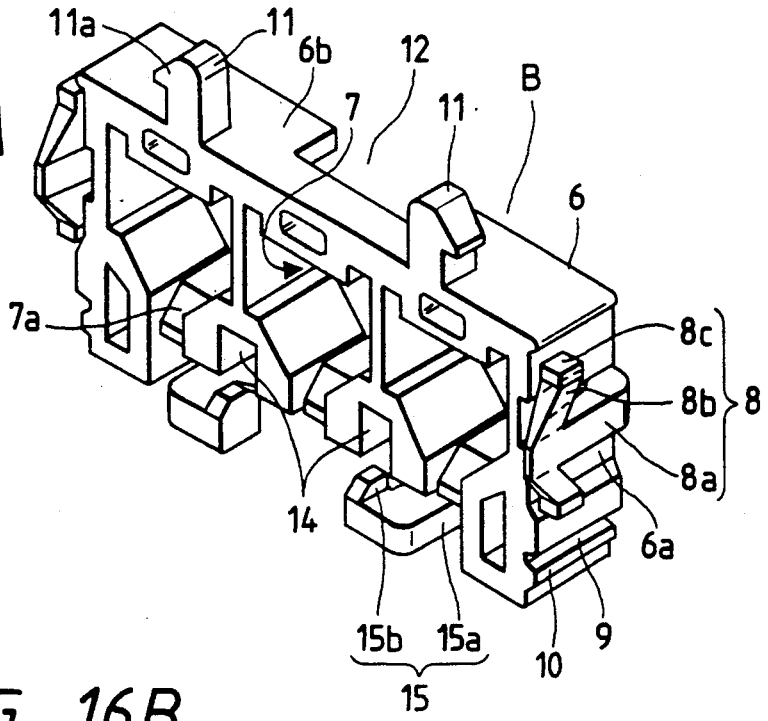
FIG. 16A is a perspective view of a terminal engagement holder of the connector as viewed backward.
Figure 16B:
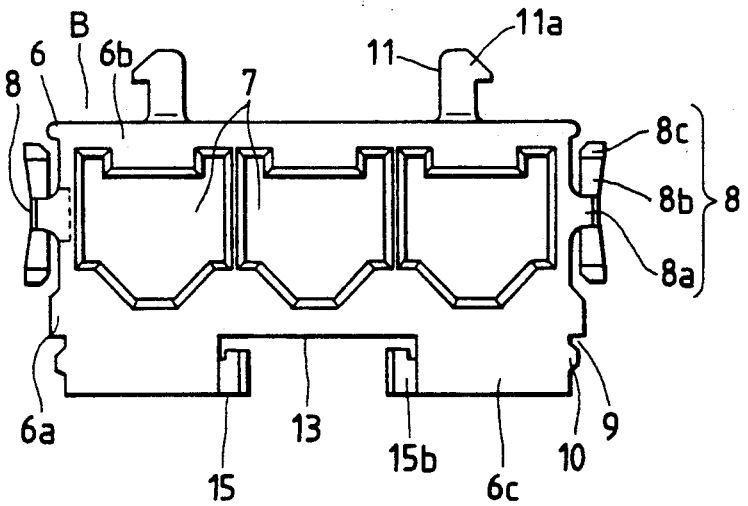
FIG. 16B is a rear view of the holder.
Figure 16C:
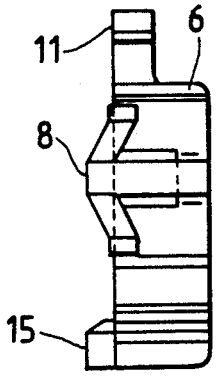
FIG. 16C is a left hand side view of the holder.

As best shown in FIGS. 13 and 14, the female connector housing A has a bracket insertion portion 40 shaped as a channel and located on the bottom of the body $A_1$ of the housing. The portion 40 can be used not only to fasten the housing $A_1$ to a bracket 42 (shown in FIGS. 18, 19 and 20) provided on the body of a vehicle or the like, but also to judge whether or not the terminal engagement holder B is engaged with the housing on a full scale. The portion 40 has a bracket insertion opening having an open end 40*a* at the rear end of the body $A_1$ of the housing, and a flexible locking part 41 located at the bottom of the portion and having a projection 41*a*.

Figure 17A:
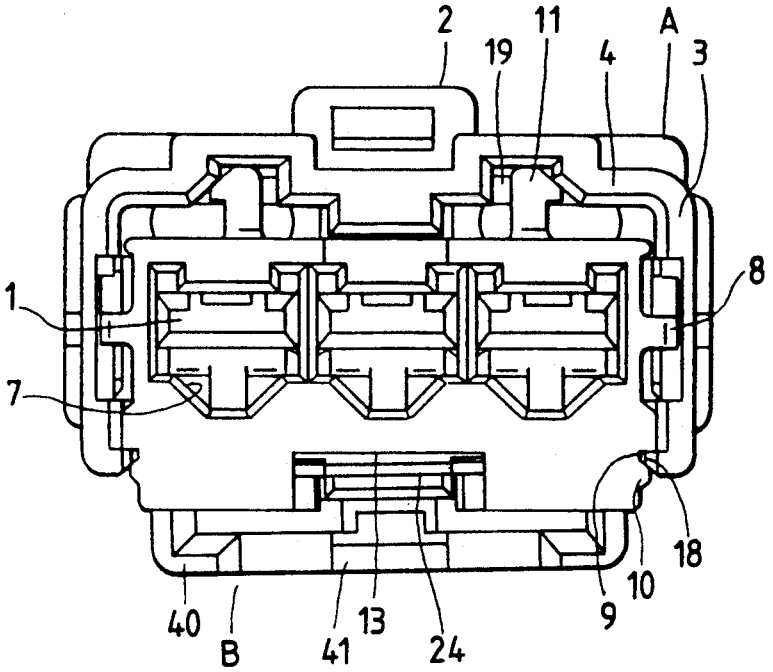
FIG. 17A is a rear view of the connector to illustrate the state that the holder is tentatively engaged with the housing.
Figure 17B:
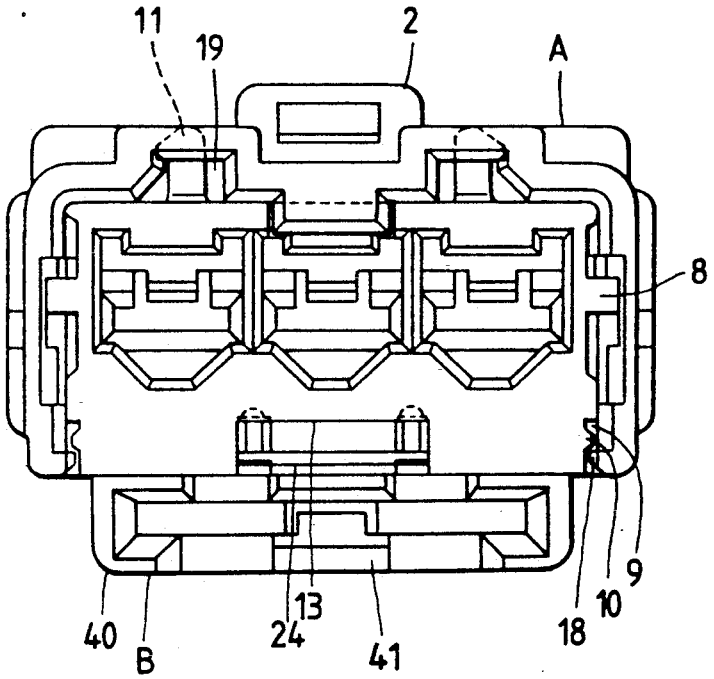
FIG. 17B is a rear view of the connector to illustrate the state that the holder is engaged with the housing on a full scale.
Figure 18:
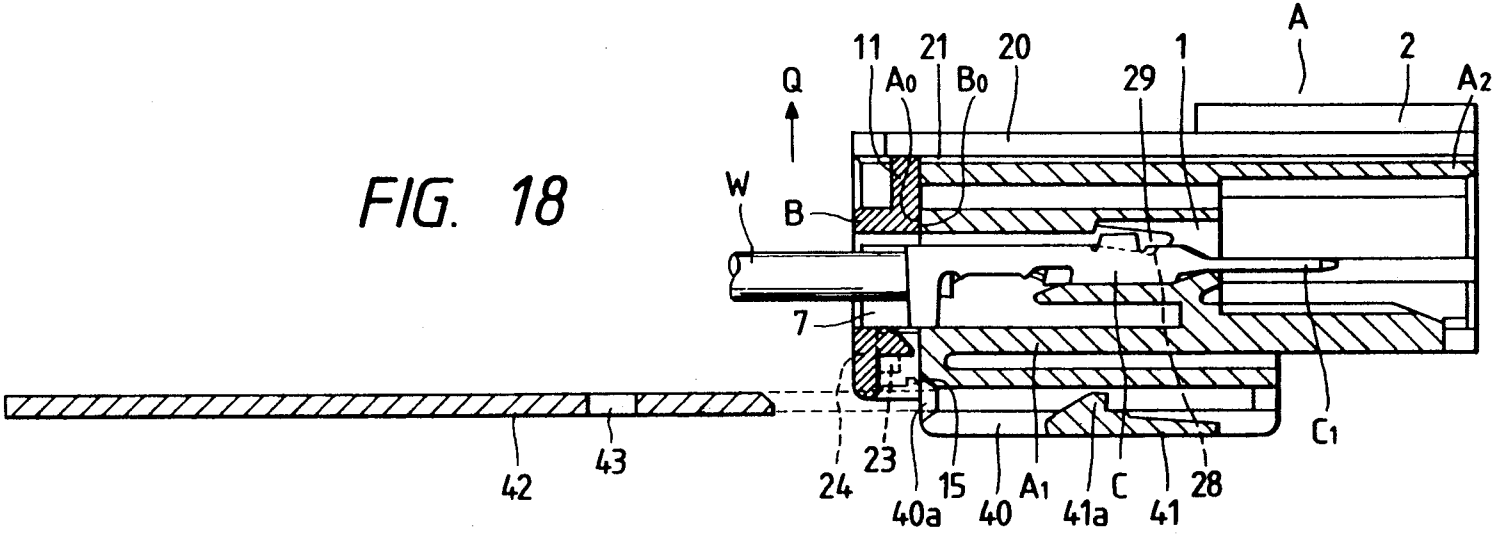
Figure 19:
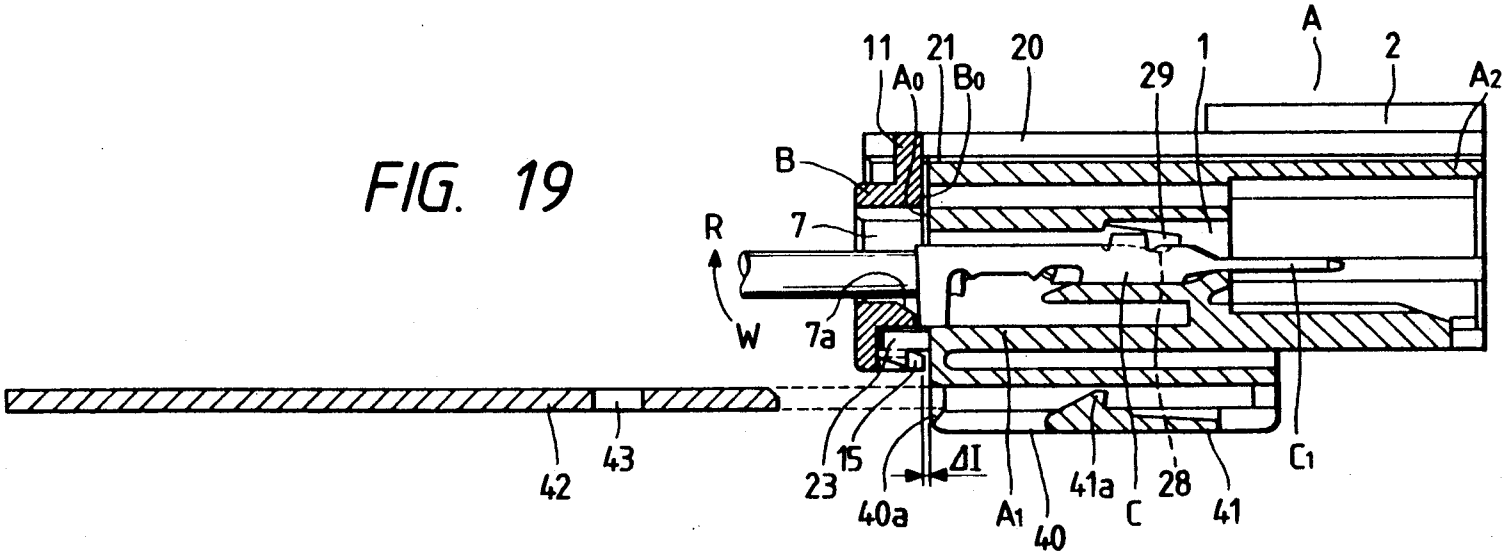
Figure 20:
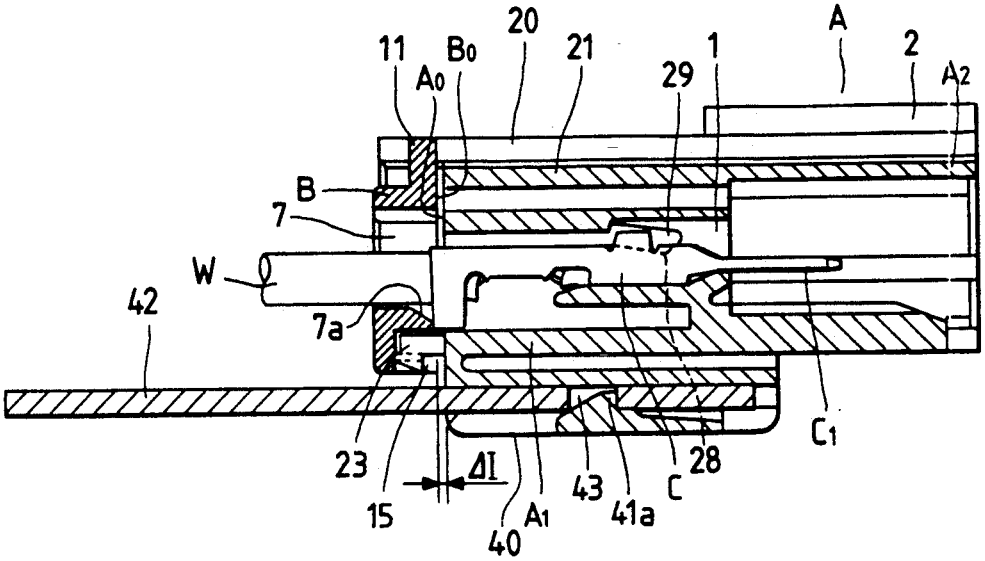
Figure 21:
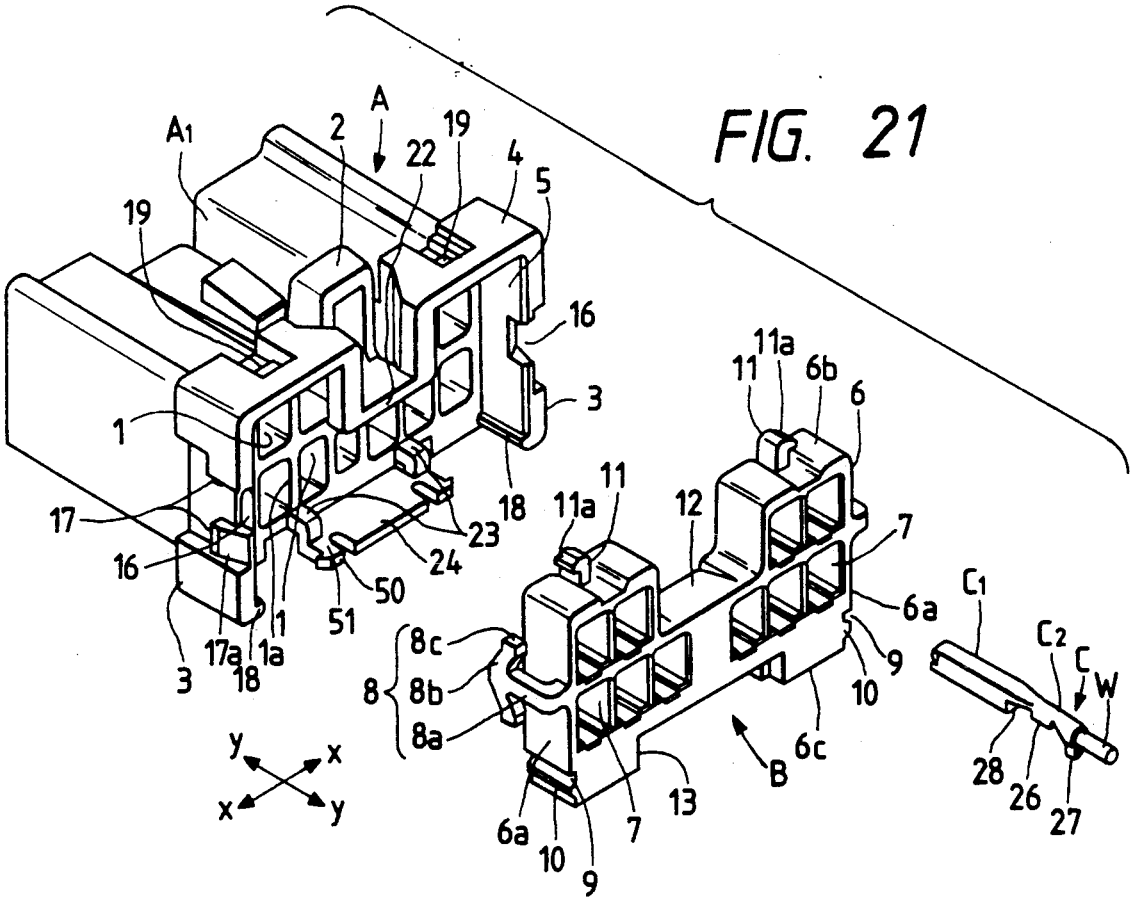
Figure 22:
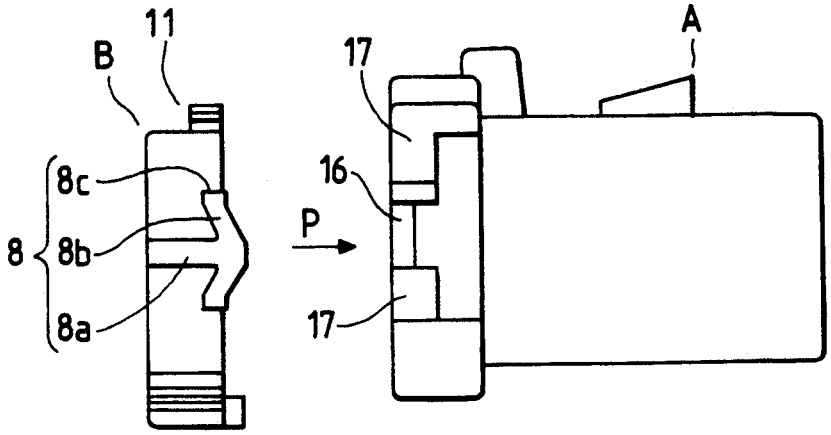
Figure 23:
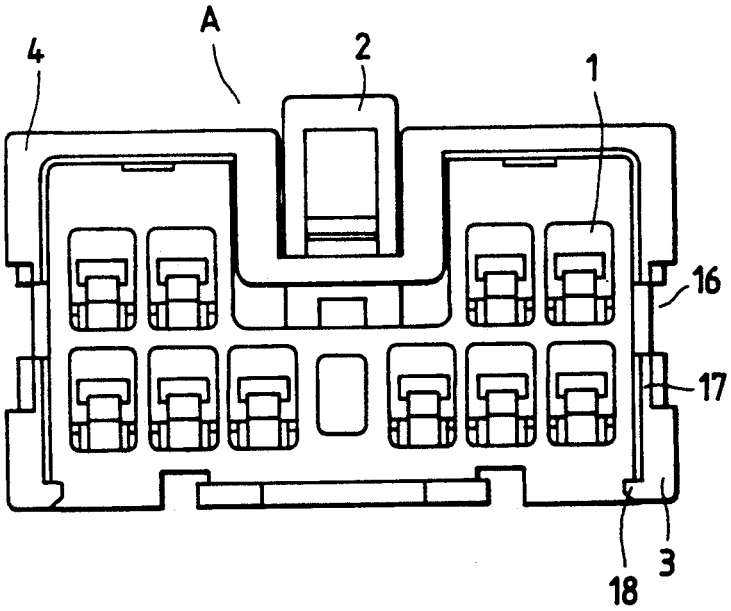

When the terminal engagement holder B is tentatively engaged with the female housing A to subject the male terminals C to the primary engagement holding but not yet engaged with the housing on the full scale, as shown in FIGS. 17A and 18, the holder blocks the open end 40*a* of the bracket insertion opening of the bracket insertion portion 40 of the housing so that the bracket 42 provided on the body of the vehicle or the like cannot be inserted into the opening to fasten the electrical connector to the bracket. For that reason, it can be surely and easily judged whether or not the holder B is in the full-scale engagement with the housing A as the holer is assembled with the housing. On the other hand, when the holder B is properly in the full-scale engagement with the housing A, as shown in FIGS. 17B and 19, the holder does not block the open end 40*a* of the bracket insertion opening of the bracket insertion portion 40 of the housing, so that the bracket 42 can be inserted into the opening to engage the projection 41*a* of the flexible locking part 41 of the portion in the locking hole 43 of the bracket to fasten the connector thereto. For that reason, the holder B can be prevented from being left in the tentative engagement with the housing at the time of assembling of the connector with the body of the vehicle or the like so as to let the connector play during the movement of the vehicle or the like to make a noise.

FIGS. 21 to 27 show an electrical connector according to still another embodiment of the present invention. Reference should be made to the drawings where like reference numerals refer to like parts.

Figure 24A:
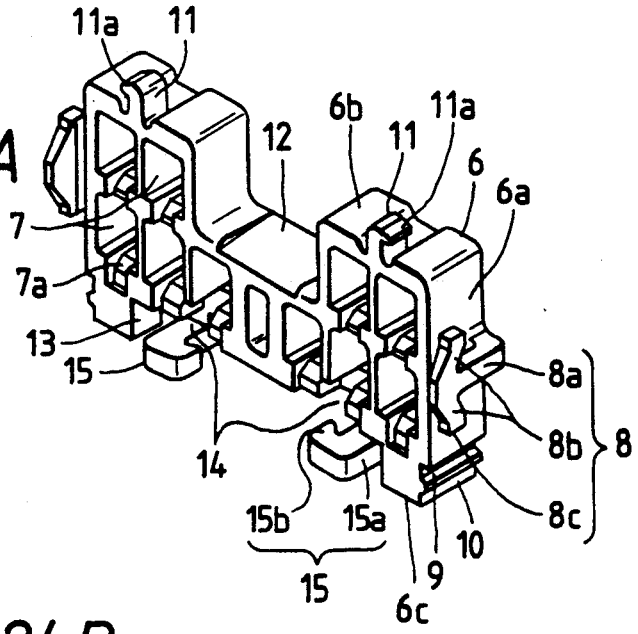
FIG. 24A is a perspective view of a terminal engagement holder of the connector as viewed backward.
Figure 24B:
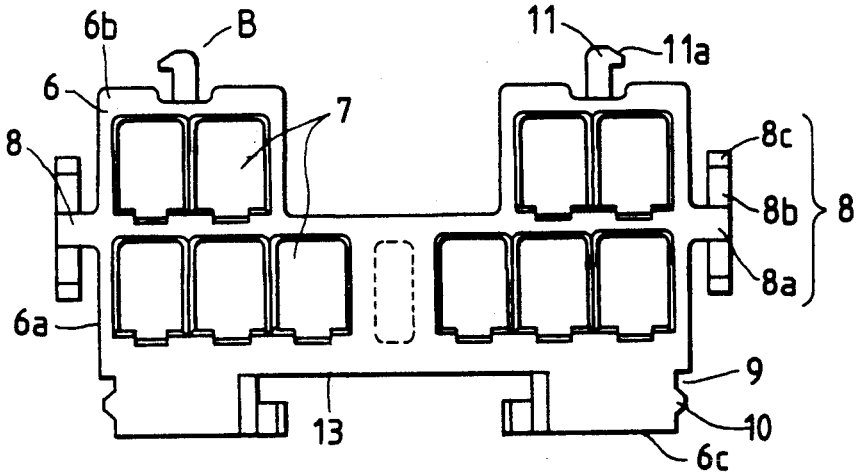
FIG. 24B is a rear view of the holder.
Figure 24C:
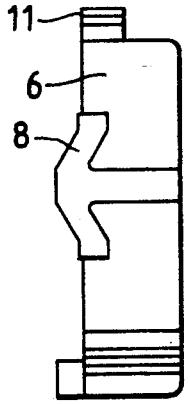
FIG. 24C is a left-hand side view of the holder.
Figure 25A:
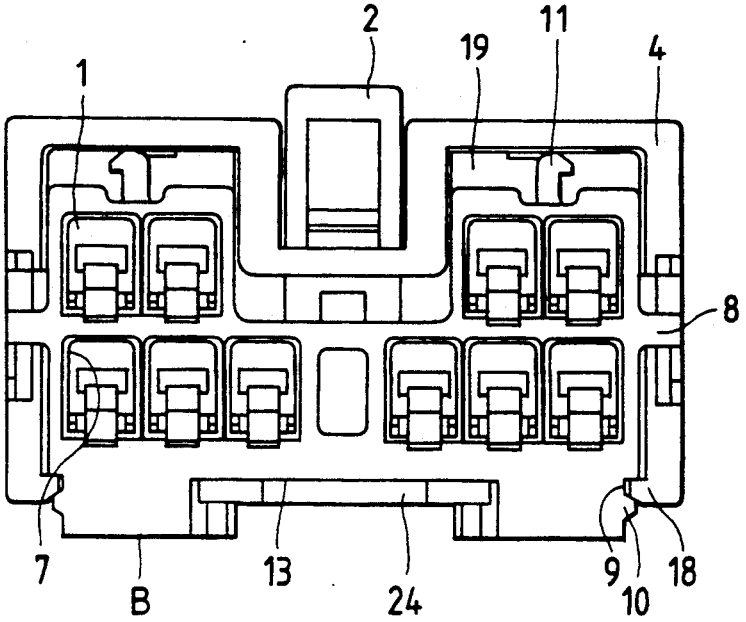
FIG. 25A is a rear view of the connector to illustrate the state that the holder is tentatively engaged with the housing.
Figure 25B:
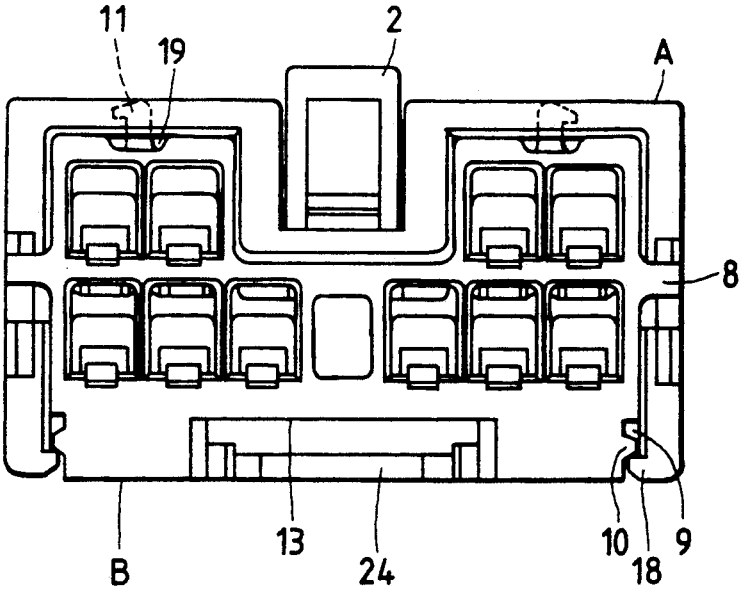
FIG. 25B is a rear view of the connector to illustrate the state that the holder is engaged with the housing on a full scale.

The connector comprising a male housing A, a terminal engagement holder B, and female terminals C. The housing A has a plurality (ten in this embodiment) of terminal chambers 1 in an upper and a lower rows to accommodate the female terminals C in the chambers. A locking arm 2 is provided on the top of the housing to fasten the male housing to a mating female housing not shown in the drawings. Each of the female terminals C has a tubular body 25 in which the tab-like portion of a male terminal is inserted. As best show in FIG. 21, the locking anchor 8 is provided on the outer part of each of the right and left side portions 6*a* of the holder B, whereas the upper and lower engagement portions 17 extending on the holder fitting opening 5 and located over and under the passage 16 is provided on the outer surface of each side portion 3 of the male housing A so that the former can be engaged with the latter. Instead of the grooves 14 in the most preceding embodiment, a pair of recesses 14 is provided in the front half of the lower portion 6*c* at both the sides of the recess 13, as best shown in FIG. 24A.

Figure 26A:
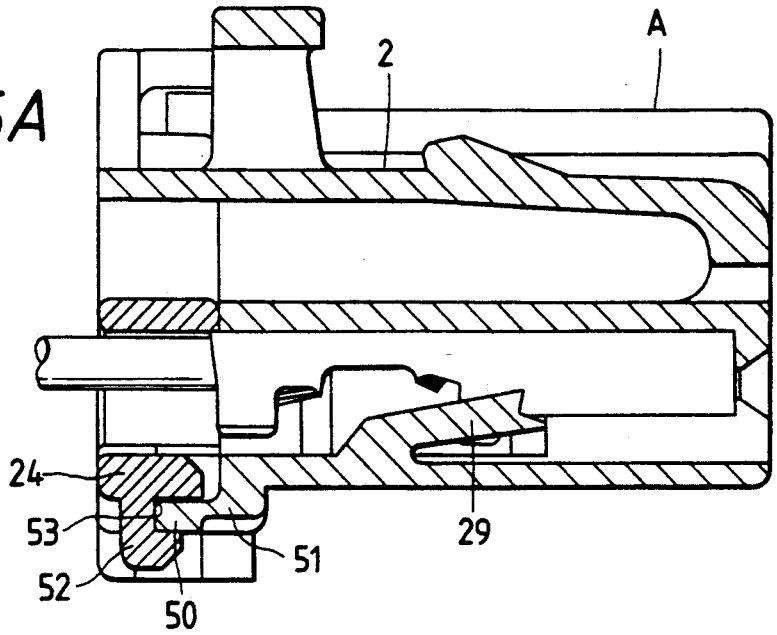
FIG. 26A is a sectional view of a major part of the connector to illustrate the state that the holder is tentatively engaged with the housing.
Figure 26B:
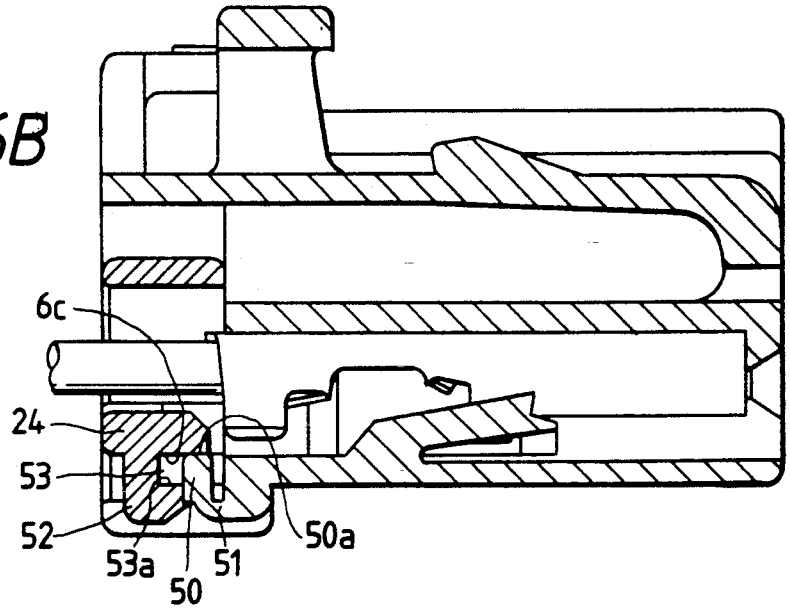
FIG. 26B is a sectional view of the major part to illustrate the holder is engaged with the housing on the full scale.
Figure 27A:
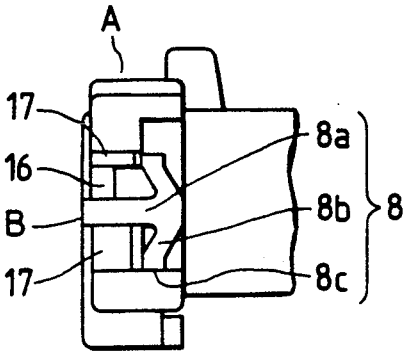
FIG. 27A is an enlarged view of a locking anchor of the holder to illustrate the state that the holder is tentatively engaged with the housing.
Figure 27B:
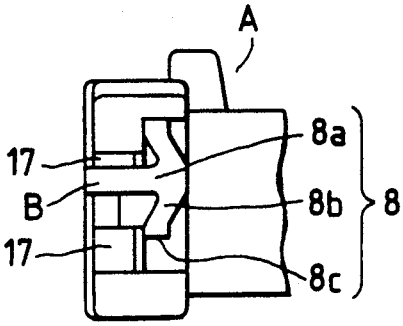
FIG. 27B is an enlarged view of the locking anchor to illustrate the state that the holder is engaged with the housing on the full scale.

The housing A has anti-unlocking juts 50 at both side edges of the guide tongue 24 in order to prevent the terminal engagement holder B from being unlocked from the housing. The juts 50 have thin portions 51 at the butts of the juts so that the juts can be swung up. The lower portion 6*c* of the holder B has jut holding parts 52 having grooves 53, as shown in FIGS. 26A and 26B. The jut holding parts 52 are located inside the anti-turning arms 15 at the bottom of the lower portion 6*c*.

When the terminal engagement holder B is tentatively engaged with the housing A' the anti-unlocking projections 50 of the housing are put in the grooves 53 of the jut holding parts 52 of the holder as shown in FIG. 26A. When the holder B is thereafter engaged with the housing A on the full scale, the juts 50 are pushed and bent up by the inner lower surfaces 53*a* of the jut holding parts 52 so that the rear ends 50*a* of the juts are put in tight contact with the bottom of the lower portion 6*c* of the holder. As a result, even if the tension of the electric wire W acts to the holder B in a direction R', the holder is kept from being shifted out of the full-scale engagement with the housing A back into the tentative engagement therewith. The double engagement holding of the female terminals C by the housing A and the holder B is thus secured.

According to the present invention, a terminal engagement holder is smoothly shifted out of tentative engagement with a housing into full-scale engagement therewith by a single step of manipulation, which is sliding or pushing the holder deeper into the rear portion of the housing in a single direction. For that reason, the efficiency of assembling of the holder and the housing is enhanced. The holder has means for urging the holder toward the housing in the full-scale engagement so that if the rear end of a terminal inserted into the housing is located slightly behind a prescribed position due to a dimensional error or the like, the means act to make it possible to cope with that positional difference so as to securely lock the holder to the housing. The housing has a bracket insertion portion into which a bracket can be inserted at the time of assembling if the holder is only in the full-scale engagement with the housing. For that reason, it can be easily judged from outside whether or not the holder is in the full engagement with the housing as the holder is assembled. Since the rear portion of the housing is provided with the means for preventing the holder from being shifted out of the full-scale engagement back into the tentative engagement, the holder is unlikely to be unexpectedly shifted out of the former back into the latter by an external force. For that reason, the double engagement holding of the terminals by the holder and the housing is secured.

What is claimed is:

1. An electrical connector, comprising:

a housing having at least one terminal chamber;

a terminal inserted into each said terminal chamber;

a terminal engagement holder mounted onto said housing for preventing each said terminal from disengaging from said housing;

first means for tentatively engaging said terminal engagement holder with said housing in response to movement of said terminal engagement holder in a first direction relative to said housing;

second means for completely engaging said engagement holder with said housing in response to movement of said terminal engagement holder, tentatively engaged with said housing, in a second direction; and third means for urging said terminal engagement holder toward said housing when said terminal engagement holder is completely engaged with said housing.

2. An electrical connector comprising:

a housing having at least one terminal chamber;

a terminal inserted into each said terminal chamber;

a terminal engagement holder mounted onto said housing for preventing each said terminal from disengaging from said housing;

first means for tentatively engaging said terminal engagement holder with said housing in response to movement of said terminal engagement holder in a first direction relative to said housing;

second means for completely engaging said engagement holder with said housing in response to movement of said terminal engagement holder, tentatively engaged with said housing, in a second direction; and a bracket insertion portion for fixing said housing onto a bracket, having an opening for inserting said bracket into said bracket insertion portion, wherein said opening is substantially closed by said terminal engagement holder tentatively engaged with said housing to prevent the insertion of said bracket, and said opening is opened to enable the insertion of said bracket when said terminal engagement holder is completely engaged with said housing.

3. An electrical connector comprising:

a housing having at least one terminal chamber;

a terminal inserted into each said terminal chamber;

a terminal engagement holder mounted onto said housing for preventing each said terminal from disengaging from said housing;

first means for tentatively engaging said terminal engagement holder with said housing in response to movement of said terminal engagement holder in a first direction relative to said housing;

second means for completely engaging said engagement holder with said housing in response to movement of said terminal engagement holder, tentatively engaged with said housing, in a second direction; and third means for positively preventing said terminal engagement holder from being shifted out of the complete engagement with said housing back into the tentative engagement therewith.

4. An electrical connector comprising:

a housing having at least one terminal chamber;

a terminal inserted into each said terminal chamber;

a terminal engagement holder mounted onto said housing for preventing each said terminal from disengaging from said housing;

first means for tentatively engaging said terminal engagement holder with said housing in response to movement of said terminal engagement holder in a first direction relative to said housing;

second means for completely engaging said engagement holder with said housing in response to movement of said terminal engagement holder, tentatively engaged with said housing, in a second direction; and third means for guiding said terminal engagement holder to be moved in said first direction, and preventing said terminal engagement holder from coming off from said housing when said terminal engagement holder is tentatively engaged with said housing.

5. An electrical connector comprising:

a housing having at least one terminal chamber;

a terminal inserted into each said terminal chamber;

a terminal engagement holder mounted onto said housing for preventing each said terminal from disengaging from said housing;

first means for tentatively engaging said terminal engagement holder with said housing in response to movement of said terminal engagement holder in a first direction relative to said housing;

second means for completely engaging said engagement holder with said housing in response to movement of said terminal engagement holder, tentatively engaged with said housing, in a second direction; and third means for preventing said terminal engagement holder from disengaging from said housing when said terminal engagement holder is completely engaged with said housing.

6. An electrical connector comprising:

a housing having at least one terminal chamber;

a terminal inserted into each said terminal chamber;

a terminal engagement holder mounted onto said housing for preventing each said terminal from disengaging from said housing;

first means for tentatively engaging said terminal engagement holder with said housing in response to movement of said terminal engagement holder in a first direction relative to said housing; and second means for completely engaging said engagement holder with said housing in response to movement of said terminal engagement holder, tentatively engaged with said housing, in a second direction substantially perpendicular to said first direction, wherein movement in said second direction occurs after movement in said first direction without any additional movement in said first direction and wherein said terminal engagement holder includes an opening corresponding to each said terminal chamber, through which said terminal is inserted into said terminal chamber when said terminal engagement holder is tentatively engaged with said housing.

7. The connector according to claim 6 further comprising:

third means for engaging said terminal with said housing when said terminal is inserted into said terminal chamber.

8. An electrical connector, comprising:

a housing having at least one terminal chamber;

a terminal inserted into each said terminal chamber;

a terminal engagement holder to be assembled with said housing;

tentative engagement means for tentatively engaging said holder with a rear portion of said housing; and full-scale engagement means for engaging said holder with said portion on a full scale after said holder is tentatively engaged with said housing, and wherein:

at least one of said tentative engagement means and full scale engagement means includes means for urging said holder toward said housing when said holder is in the full-engagement with said portion.

9. An electrical connector, comprising:

a housing having at least one terminal chamber;

a terminal inserted into each said terminal chamber;

a terminal engagement holder to be assembled with said housing;

tentative engagement means for tentatively engaging said holder with a rear portion of said housing;

full-scale engagement means for engaging said holder with said portion on a full scale after said holder is tentatively engaged with said housing; and a bracket insertion portion formed on an outer surface of said housing and having a bracket reception opening whose open end is located at a rear end of said housing so that said open end is blocked by said holder in the tentative engagement, and not blocked by said holder in the full-scale engagement.

10. An electrical connector, comprising:

a housing having at least one terminal chamber;

a terminal inserted into each said terminal chamber;

a terminal engagement holder to be assembled with said housing;

tentative engagement means for tentatively engaging said holder with a rear portion of said housing;

full-scale engagement means for engaging said holder with said portion on a full scale after said holder is tentatively engaged with said housing; and means provided on said portion for preventing said holder from being shifted out of the full-scale engagement back into said tentative engagement.

* * * * *